US005961283A

United States Patent [19]

Imai et al.

[11] Patent Number: 5,961,283

[45] **Date of Patent: *Oct. 5, 1999**

[54] DRAINAGE PUMP WITH NOISE AND VIBRATION REDUCING FEATURES

[75] Inventors: Masayuki Imai; Takashi Endo; Tatsushi Ninomiya, all of Tokyo, Japan

[73] Assignee: Fujikoki Corporation, Tokyo, Japan

[ * ] Notice: This patent is subject to a terminal disclaimer.

[21] Appl. No.: 08/927,690

[22] Filed: Sep. 11, 1997

[30] Foreign Application Priority Data

Oct. 11, 1996 [JP] Japan ..... H8-270008

[51] Int. Cl.[6] ..... F04D 1/00

[52] U.S. Cl. ..... 415/199.6; 415/206; 415/207; 416/175

[58] Field of Search ..... 415/199.6, 206, 415/207, 218.1, 219.1; 416/175, 181, 203, 201 A

[56] References Cited

U.S. PATENT DOCUMENTS

| | | | |
|---|---|---|---|
| 1,512,243 | 10/1924 | Shrode . | |
| 1,987,948 | 1/1935 | Smith . | |
| 2,306,768 | 12/1942 | Wile . | |
| 2,361,750 | 10/1944 | Dinsmore et al. . | |
| 2,642,510 | 6/1953 | Ingwersen . | |
| 3,290,021 | 12/1966 | Blachly et al. . | |
| 3,746,465 | 7/1973 | Van Doorn et al. . | |
| 3,758,236 | 9/1973 | Zimmerman . | |
| 4,637,779 | 1/1987 | Sherman et al. | 415/199.6 |
| 4,815,698 | 3/1989 | Palmer . | |
| 4,826,398 | 5/1989 | Gullichsen . | |
| 4,890,980 | 1/1990 | Heald et al. . | |
| 4,940,385 | 7/1990 | Gurth . | |
| 4,973,231 | 11/1990 | Colliver . | |
| 5,044,887 | 9/1991 | Duthie et al. . | |
| 5,209,641 | 5/1993 | Hoglund et al. | 416/181 |
| 5,257,911 | 11/1993 | Mota et al. | 417/63 |
| 5,522,989 | 6/1996 | Hove . | |
| 5,605,439 | 2/1997 | Endoh et al. | 416/175 |
| 5,628,618 | 5/1997 | Imai et al. | 416/175 |

FOREIGN PATENT DOCUMENTS

| | | |
|---|---|---|
| 831073 | 10/1938 | France . |
| 1050101 | 1/1954 | France . |
| 2720121 | 11/1995 | France . |
| 41 28 535 | 3/1993 | Germany . |
| 05 322381 | 12/1993 | Japan . |
| 8-144996 | 4/1996 | Japan . |
| 709767 | 6/1954 | United Kingdom . |

*Primary Examiner*—Timothy S. Thorpe
*Assistant Examiner*—Cheryl J. Tyler
*Attorney, Agent, or Firm*—Foley & Lardner

[57] ABSTRACT

A drainage pump has a pump body, a vane, a ring, and a circumferential wall. The pump has a cylindrical small vane pump chamber and a large vane pump chamber extending from and communicating with the small vane pump chamber. A suction inlet communicates with the small vane pump chamber and a discharge outlet communicates with the large vane pump chamber. A chamber slope portion is formed between the small vane pump chamber and the large vane pump chamber. The vane is adapted to be driven by a motor and is rotatably mounted to the pump body. The vane includes a large vane portion received in the large vane pump chamber and a small vane portion extending from the large vane and received in the small vane pump chamber. The small vane portion and the large vane portion rotate together when driven by the motor. A vane slope portion is formed between the large vane portion and the small vane portion. The ring has a central opening, positioned between the large vane portion and the small vane portion. The small vane portion extends through the central opening. The circumferential wall surrounds the periphery of the large vane portion and extends upwardly from the ring. The ring covers the lower end of the large vane portion. The circumferential wall collides against any drainage water returning from the discharge outlet into the pump body to absorb shock and prevent the drainage water from returning directly to the pump body from the discharge outlet.

9 Claims, 2 Drawing Sheets

DRAINAGE PUMP WITH NOISE AND VIBRATION REDUCING FEATURES

TECHNICAL FIELD OF THE INVENTION

The present invention relates to drainage pumps and, more particularly, to drainage pumps equipped in air conditioners.

BACKGROUND OF THE INVENTION

When the indoor unit of an air conditioner is driven in a cooling mode, the vapor in the air will condensate and adhere to a heat exchanger, and drops to a drainage pan mounted underneath. A drainage pump is equipped for draining the drainage water gathered in the drainage pan. There are many varieties of such drainage pumps proposed in the prior art. For example, a prior art drainage pump comprises a housing having a suction inlet at the lower portion, an opening at the upper portion, and a discharging outlet on the side, and a vane mounted rotatively inside the housing. The vane rotates by a motor fixed via a cover to the upper portion of the opening of the housing. The rotation shaft of the motor extends through the cover rotatively and is connected to the shaft of the vane. The cover is equipped with a through hole for connecting air and the housing. When the motor is driven and the vane rotates, the drainage water gathered inside the drainage pan will be sucked in from the lower end of the vane of the suction inlet, is pumped along the inner surface of the housing, and discharged from the discharging outlet of the casing.

The operation of a drainage pump of the prior art of the above type disclosed in Japanese Patent Laid-Open No. H8-144996 is shown in FIGS. 3A and 3B. FIG. 3A shows the upper view of the interior of the drainage pump, and FIG. 3B shows the front view of the interior of the drainage pump. FIG. 3A depicts the bubbles.

A pump body 10 of a drainage pump 1A comprises a pump chamber 12, a suction inlet 15 and a discharging outlet 17. A rotation vane 100 equipped inside the body 10 is connected to a motor (not shown) mounted on the upper portion of the pump body 10 and comprises a shaft 110, four large vanes 120 and a cutwater board 34, wherein a gap 32 is formed between the shaft 110 and the cover 30 of the body. Underneath the large vane 120 is a small vane 130 for raising the drainage water sucked in from the suction inlet. A disc 150 is connected to the lower peripheral of the large vane 120. The disc 150 includes a hollow portion 155 for keeping back and dividing a portion of the drainage water rising from the suction inlet. As a result, the amount of water contacting the large vane 120 at the upper portion of the disc 150 decreases, and the load that the rotation vane receives will reduce. At the same time, the collision of the bubble and the vane will decrease, reducing noise and vibration.

In a prior art drainage pump as is described above, when the stage of the water is low or the lift is low at the suction inlet 15, the liquid-vapor boundary surface formed on the inner side of the drainage stream will be divided by the disc 150 as is shown by $W_2$, and a portion of the drainage water will be kept back. However, when the stage of the water is high or the lift is high, the liquid-vapor boundary surface will form a connected curve surface as is shown by $W_1$, and the drainage water will not be divided at the liquid-vapor boundary surface. Therefore, the drainage water contacting the large vane 120 will increase, and the collision of the bubble and the vane will increase, causing noise. This may prevent the decrease of noise necessary in the indoor unit of air conditioners.

Therefore, the present invention aims at providing a drainage pump with decreased noise even when the stage of the water is high or the lift is high.

SUMMARY OF THE INVENTION

The above object can be achieved with a drainage pump according to the present invention. The drainage pump according to the invention can include a pump body, a vane, a ring, and a circumferential wall.

The pump body can include a cylindrical small vane pump chamber and a large vane pump chamber extending from and communicating with the small vane pump chamber. A suction inlet communicates with the small vane pump chamber and a discharge outlet communicates with the large vane pump chamber. A chamber slope portion can be formed between the small vane pump chamber and the large vane pump chamber.

The vane is adapted to be driven by a motor and is rotatably mounted to the pump body. The vane can include a large vane portion received in the large vane pump chamber and a small vane portion extending from the large vane and received in the small vane pump chamber. The small vane portion and the large vane portion rotate together when driven by the motor. A vane slope portion can be formed between the large vane portion and the small vane portion.

The ring has a central opening, positioned between the large vane portion and the small vane portion. The small vane portion extends through the central opening. The circumferential wall surrounds the periphery of the large vane portion and extends upwardly from the ring. The ring covers the lower end of the large vane portion. The circumferential wall collides against any drainage water entering from the discharge outlet into the pump body to absorb shock and prevent any drainage water from returning directly into the pump body. The ring and the circumferential wall can rotate together with the vane.

The small vane pump chamber can extend collinearly from the large vane pump chamber. Similarly, the small vane portion can extend collinearly from the large vane portion. The small vane portion can have four plate-type vanes extending radially relative to an axis of rotation thereof. The vane slope portion can taper toward the small vane portion. The angle of the vane slope portion and the angle of the chamber slope portion can be substantially the same.

The drainage pump can further include a cover member and a shaft connected to the vane. The cover can have a hole so that the shaft can extend through it.

DETAILED DESCRIPTION

Figure 1:
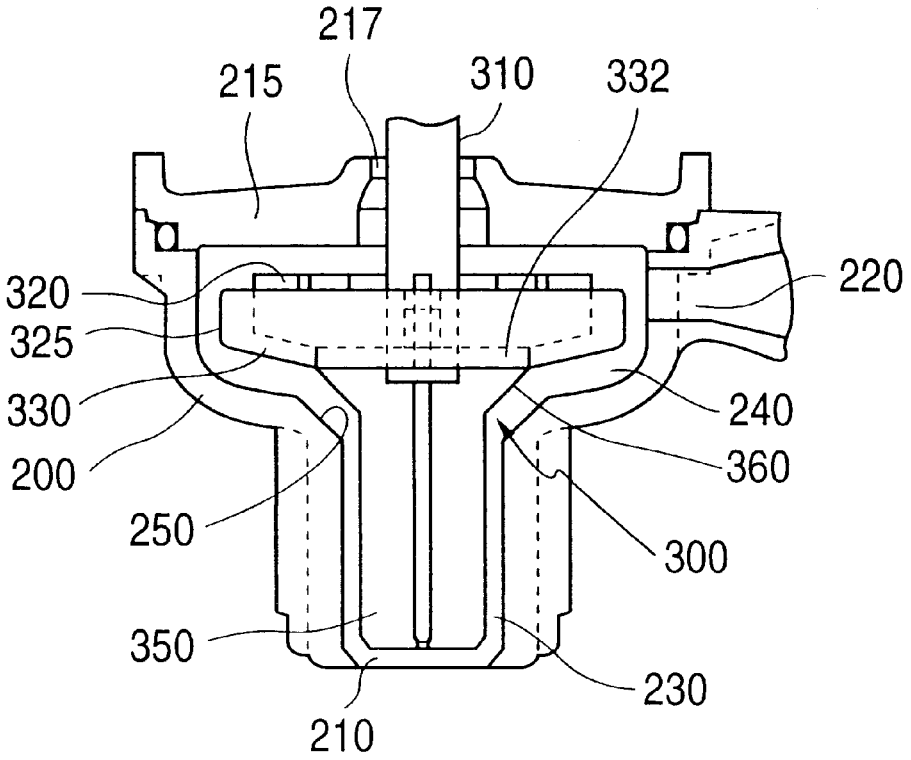
FIG. 1 shows a side view of the drainage pump of the present invention showing a portion in cross-section.

FIG. 1 is an explanatory view showing a cross-sectional view of the body of the drainage pump and the front view of the rotation vane of the present invention.

The body 200 of the drainage pump of the present invention includes a suction inlet 210 and a discharging outlet 220. A rotation vane 300 positioned inside the body 200 comprises a small vane 350 having four plate-type vanes extending to the radial direction, and a large vane 320 connected to the small vane 350. The peripheral of the large vane 320 is surrounded by a circumferential wall 325, and a tapered ring 330 is connected to the lower end of the circumferential wall 325 covering the low end of the large vane 320. Any drainage water returning to the pump body from a discharging outlet 17 collides against the circumferential wall 325, so that the wall 325 works as a shock absorber against the drainage water, preventing the drainage water from returning inside the pump body directly from the discharging outlet. Therefore, noise is reduced. A rim portion 360 of the large vane 320 continuing to the small vane 350 is formed in a tapered shape. The center of the tapered ring 330 has an opening 332 that connects through to the area of the small vane 350.

The upper portion of the pump body 200 is covered by a cover member 215, and a shaft 310 of the rotation vane 300 passes through a through hole 217 of the cover member 215 and projects toward the driving shaft of the motor.

The pump body 200 comprises a small vane pump chamber 230 for accommodating the small vane 350 and a large vane pump chamber 240 surrounding the large vane 320. The cylindrical small vane pump chamber 230 and the large vane pump chamber 240 are connected by a chamber slope portion 250.

The outer rim of the rotation vane 300 opposing the slope portion 250 of the body 200 is also formed as a vane slope portion 360. The angle of the slope portion 250 of the body 200 and the angle of the slope portion 360 of the rotation vane 300 are substantially the same.

Figure 2:
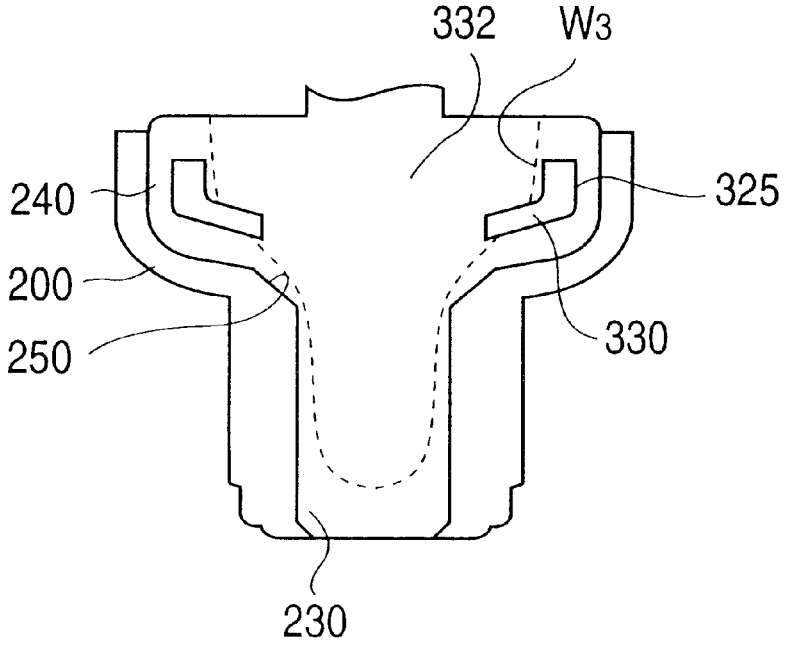
FIG. 2 shows an explanatory view showing the operation of the present invention.
Figure 3A:
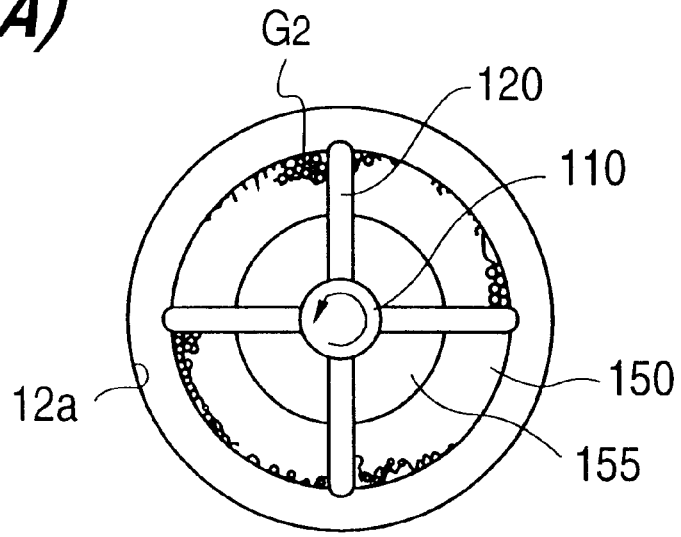
FIGS. 3A and 3B show explanatory views of the drainage pump structure.
Figure 3B:
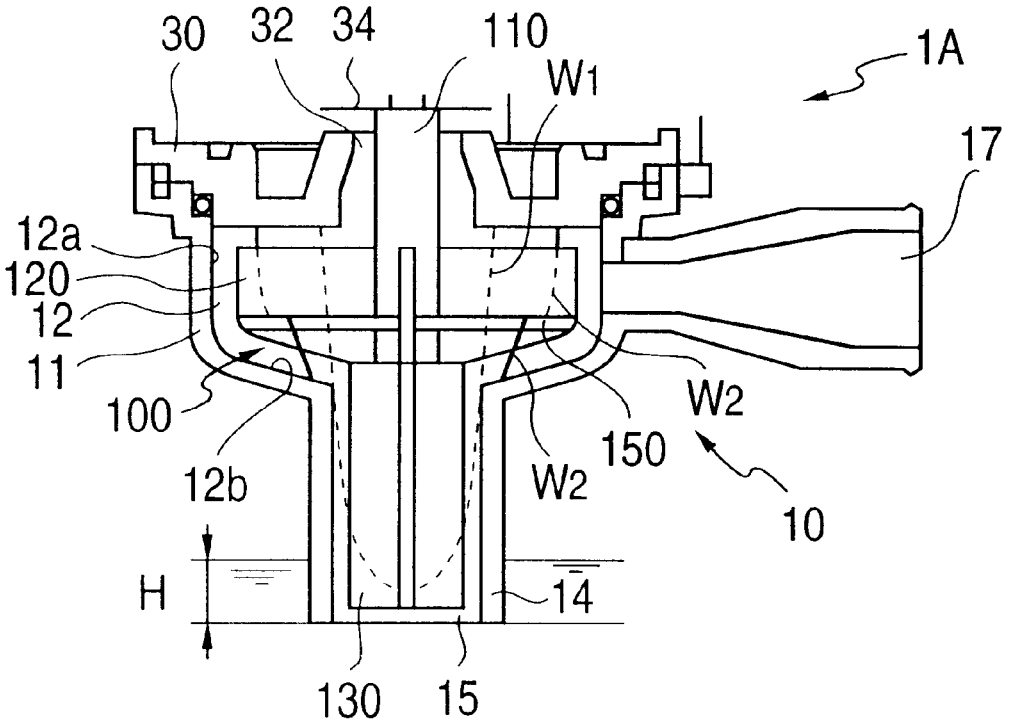

FIG. 2 is a cross-sectional view explaining the shape of the liquid-vapor boundary surface $W_3$ formed on the inner side of the drainage flow inside the pump body 200 when the drainage pump is operated.

The small vane pump chamber 230 of the body 2 the large vane pump chamber 240 are connected by the slope portion 250, so that the drainage water rotating and rising along the inner wall of the small vane pump chamber 230 by the centrifugal force caused by the rotation of the small vane 350 is expanded to the radial direction along the slope portion 250. As a result, the liquid-vapor boundary surface $W_3$ is likely to expand, forming a parabola with a large radius size. The liquid-vapor boundary surface $W_3$ will therefore be divided by the tapered ring 330, a portion of the drainage water will be kept back, the amount of drainage water contacting the large vane 320 will be reduced, resulting in the reduction of the collision of the bubbles against the large vane, and low noise could be realized. Further, the load of the motor could be reduced. Therefore, low noise could be maintained even when the stage of the water or the lift is high.

By the drainage pump of the present invention comprising a rotation vane having a shaft portion connected to the driving shaft of the motor, a plurality of plate-shaped large vanes extending to the radial direction from the outer peripheral of the shaft portion, a plate-shaped small vane formed continuously to the lower rim of the large vane, and a slope portion formed on the connecting point of the large vane and the small vane, wherein a pump body accommodates the small vane, the end portion thereof accommodates a cylindrical small vane pump chamber and a large vane pump chamber, and having a slope portion formed on the connecting portion of the small vane pump chamber and the large vane pump chamber, a desirable liquid-vapor boundary surface could be achieved when the stage of the water or the lift is high, enabling improved performance of the pump.

What is claimed is:

1. A drainage pump comprising:

a pump body having:

a cylindrical small vane pump chamber;

a suction inlet communicating with the small vane pump chamber;

a large vane pump chamber extending from and communicating with the small vane pump chamber;

a discharge outlet communicating with the large vane pump chamber; and a chamber slope portion formed between the small vane pump chamber and the large vane pump chamber;

a vane adapted to be driven by a motor and rotatably mounted to the pump body, the vane having:

a large vane portion received in the large vane pump chamber; and a small vane portion extending from the large vane and received in the small vane pump chamber, the small vane portion and the large vane portion rotating together when driven by the motor;

a ring having a central opening, positioned between the large vane portion and the small vane portion, wherein the small vane portion extends through the central opening; and a circumferential wall surrounding the periphery of the large vane portion and extending substantially upwardly from the ring, the ring covering the lower end of the large vane portion, wherein the circumferential wall collides against any drainage water returning into the pump body from the discharge outlet to absorb shock and prevent the drainage water from returning directly into the pump body from the discharge outlet.

2. A drainage pump according to claim 1, wherein the ring and the circumferential wall rotate together with the vane.

3. A drainage pump according to claim 1, wherein the small vane pump chamber extends collinearly from the large vane pump chamber.

4. A drainage pump according to claim 1, wherein the small vane portion extends collinearly from the large vane portion.

5. A drainage pump according to claim 1, wherein the small vane portion has four plate-type vanes extending radially relative to an axis of rotation thereof.

6. A drainage pump according to claim 5, wherein the vane further includes a vane slope portion formed between the large vane portion and the small vane portion, the vane slope portion tapering toward the small vane portion.

7. A drainage pump according to claim 6, wherein the angle of the vane slope portion and the angle of the chamber slope portion are substantially the same.

8. A drainage pump according to claim 1, further including a cover member and a shaft connected to the vane, wherein the cover has a hole, the shaft extending through the hole.

9. A drainage pump according to claim 1, wherein the vane further includes a vane slope portion formed between the large vane portion and the small vane portion.

* * * * *